US007196325B2

(12) United States Patent
Syage

(10) Patent No.: US 7,196,325 B2
(45) Date of Patent: Mar. 27, 2007

(54) GLOW DISCHARGE AND PHOTOIONIZAITON SOURCE

(75) Inventor: Jack A. Syage, Huntington Beach, CA (US)

(73) Assignee: Syagen Technology, Tustin, CA (US)

( * ) Notice: Subject to any disclaimer, the term of this patent is extended or adjusted under 35 U.S.C. 154(b) by 0 days.

(21) Appl. No.: 11/138,594

(22) Filed: May 25, 2005

(65) Prior Publication Data

US 2006/0284103 A1 Dec. 21, 2006

(51) Int. Cl.
*H01J 49/10* (2006.01)
*H01J 27/24* (2006.01)

(52) U.S. Cl. ..... 250/288; 250/250; 250/423 P; 250/382

(58) Field of Classification Search ..... 250/288
See application file for complete search history.

(56) References Cited

U.S. PATENT DOCUMENTS 3,626,181 A 12/1971 Wernlund
4,476,392 A * 10/1984 Young ..... 250/288
4,849,628 A 7/1989 McLuckey et al.
5,338,931 A 8/1994 Spangler et al.
5,808,299 A 9/1998 Syage
5,968,837 A 10/1999 Doring et al.
6,211,516 B1 4/2001 Syage et al.
6,326,615 B1 * 12/2001 Syage et al. ..... 250/288
6,329,653 B1 12/2001 Syage et al.
6,434,765 B1 8/2002 Burns et al.

FOREIGN PATENT DOCUMENTS

DE 42 32 509 A1 3/1994
EP 1 070 960 A2 1/2001
WO WO 00/52432 9/2000
WO WO 2005/031306 A2 4/2005

OTHER PUBLICATIONS

Heeren, Ron M.A. et al., "Rapid microscale analyses with an external ion source Fourier transform ion cyclotron resonance mass spectrometer", Mar. 31, 1996.

* cited by examiner

*Primary Examiner*—Nikita Wells
*Assistant Examiner*—James J. Leybourne
(74) *Attorney, Agent, or Firm*—Ben J. Yorks; Irell & Manella LLP

(57) ABSTRACT

A detector that may contain a glow discharge ionizer and a photo-ionizer. The existence of both ionizers may increase the accuracy and number of chemical compounds that can be simultaneously monitored for chemical screening applications. The detector is particularly useful for screening explosives, chemical agents, and other illicit chemicals.

24 Claims, 3 Drawing Sheets

GLOW DISCHARGE AND PHOTOIONIZAITON SOURCE

BACKGROUND OF THE INVENTION

1. Field of the Invention

The present invention relates to the field of detection apparatus used to screen for the presence of explosives and other chemical entities.

2. Background Information

Safeguarding the public against illicit chemical attacks is a great concern. Explosives and chemical weapons are two classes of chemicals that can be immediately fatal. Biological weapons involving infectious organisms are also a great concern. It is imperative that new detection technology be capable of detecting an expanding list of chemical threats. It is also desirable to provide a detection system that performs quickly and with high accuracy in order to minimize disruption to the general public due to intolerable waits and excessive false detections.

A mass spectrometer (MS) and an ion mobility spectrometer (IMS) are typically used to detect one or more trace molecules from a sample. For example, a MS and IMS spectrometer can be used to detect the existence of dangerous compounds such as explosives and chemical weapons. MS and IMS detect compounds by ionizing the molecules and measuring their properties under the influence of an electric field.

The detection of explosive compounds by MS and IMS is almost always done by negative ionization due to the high electron affinity of explosives compounds due to their common presence of nitro groups. Other classes of compounds such as chemical weapons and drugs are best detected by positive ionization. Therefore it is desirable to provide a detector that can create both positive and negative ionization.

U.S. Pat. No. 4,849,628 issued to McLuckey et al. discloses an ionizer commonly referred to as a glow discharge ionizer (GDI). GDIs are capable of achieving both positive and negative ionization. The ionizer operates at about 1 torr of pressure. One advantage of a GDI is that at low pressure ion suppression due to reactions of the ions with other trace molecules is minimized. At higher pressure it is possible for the desired ion to react or to lose its charge in collisions with other molecules. However, the GDI source operates with an electric field to maintain the discharge and this causes an acceleration of the ions, which can fragment due to collisions with background gas. This fragmentation is often undesirable. Negative ionization usually occurs only for molecules with high electron affinity, however, positive ionization occurs for most molecules including the background gas, which is typically air.

It is desirable to have a positive and negative ionization source that does not suffer from ion suppression, exhibits minimum fragmentation, and that is specific to trace compounds such as explosives, chemical weapons, drugs and other classes of compounds.

U.S. Pat. No. 5,808,299 issued to Syage discloses a mass spectrometer that contains a photo-ionizer. The photo-ionizer includes a light source that can emit a light beam into a gas sample. The light beam has an energy level that will ionize constituent molecules without creating an undesirable amount of fragmentation. Additionally, the light beam does not ionize common background molecules such as the constituents of air. The molecules are typically ionized at sub atmospheric pressures, which minimizes ion suppression. U.S. Pat. No. 6,211,516 issued to Syage et al. discloses a photo-ionizer for mass spectrometry (MS) that operates at higher pressures including atmospheric pressure. U.S. Pat. No. 6,434,765 issued to Robb et al. discloses an atmospheric pressure photo-ionizer that uses dopant molecules to facilitate the ionization process in a process that involves solvent molecules. The use of dopants or reagent gases to enhance the sensitivity of photo-ionization has been disclosed for ion mobility spectrometry (IMS) in U.S. Pat. No. 5,338,931 issued to Spangler et al. and in U.S. Pat. No. 5,968,837 issued to Doering et al.

Generally photo-ionization produces a positively charged ion. This occurs because the absorption of a photon by a molecule can lead to dissociation of an electron. The Doering patent discloses a method for enhancing formation of negative ions by photo-ionization for IMS by using a high abundance of reagent or dopant molecules. The dopant molecules are chosen to be photo-ionizable. This creates a large abundance of positive photons and electrons. The electrons can then attach to other molecules to form a negatively charged ion.

Conventional methods of forming negative ions include atmospheric pressure chemical ionization (APCI) and electrospray ionization (ESI). These two methods require a high electric field to operate. The APCI process generates a plasma of positive and negative ions and electrons. Electron attachment and other ion molecule reactions can occur to form desired negative ions. In an ESI process, charged droplets are produced that can either be positively or negatively charged depending on the polarity of the voltage applied to the device. APCI and ESI operate at atmospheric pressure and thus ions that are formed can be suppressed by the abundance of ion-molecule collisions.

It is generally desirable to produce ions, such as negative ions, without having to introduce a supply of dopant molecules. It is also generally desirable to produce ions without the use of electric fields, which can cause undesirable ion molecule reactions.

It is also generally desirable to be able to produce negative ions over a wide range of pressures including atmospheric pressure and higher, and sub-atmospheric pressures.

BRIEF SUMMARY OF THE INVENTION

Disclosed is a detector system that may contain a glow discharge ionizer and a photo-ionizer. The flow discharge ionizer may include a first electrode separated from a second electrode by an ionization chamber. The ionization chamber may be coupled to a detector. Alternatively, the detector system may include a photo-ionizer and a photocathode that can create electrons within the ionization chamber.

DETAILED DESCRIPTION

Figure 1:
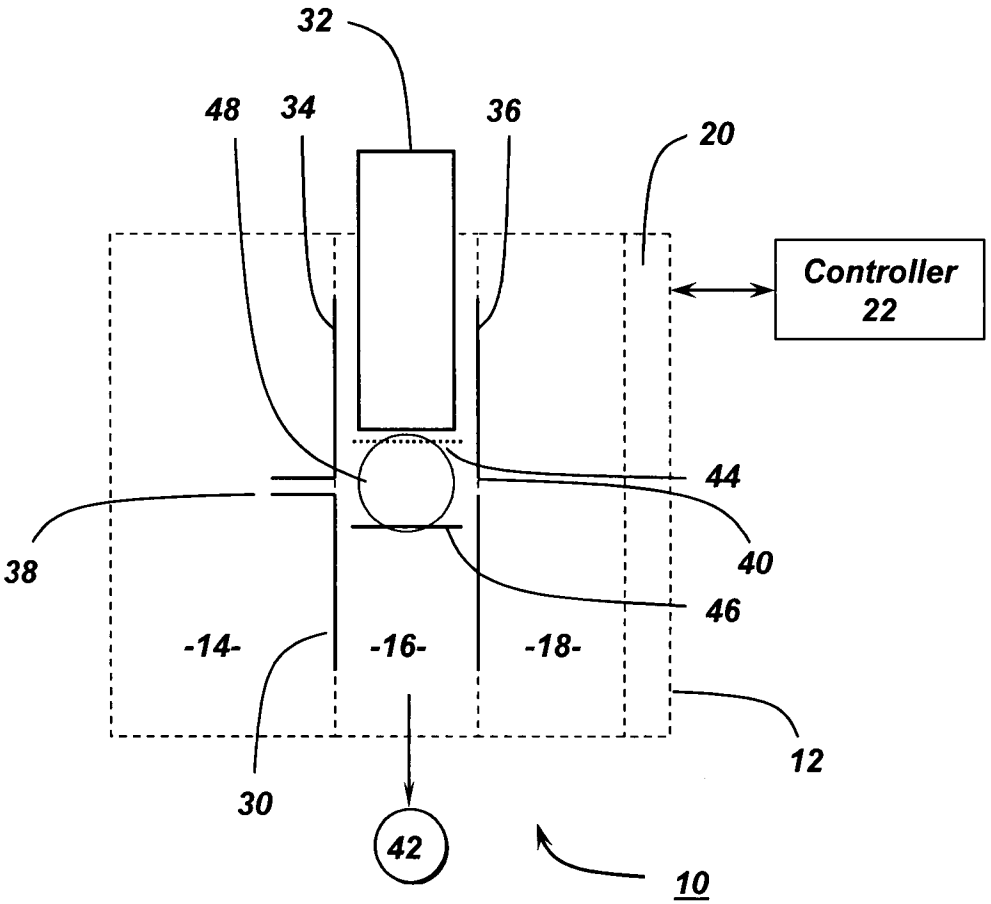
FIG. 1 is a diagram showing an embodiment of a detector with a glow discharge ionizer and a photo-ionizer.

Disclosed is a detector that may contain a glow discharge ionizer and a photo-ionizer. The existence of both ionizers may increase the accuracy and number of chemical compounds that can be simultaneously monitored for chemical screening applications. The detector is particularly useful for screening explosives, chemical agents, and other illicit chemicals.

The photo-ionizer may form positive ions for molecules that have reasonably low ionization potentials such as chemical weapons agents and drug compounds. The glow discharge ionizer can form negative ions from molecules that have high electron affinities such as explosives compounds. The advantage of the dual ionizer embodiment is an increase in the range of detectable compounds.

The photons from the photo-ionizer may impinge on a photocathode material that photoemits low energy electrons. The electrons can attach to molecules to form negative ions. In this way the photo-ionizer can be used to form both positive and negative ions. The detector may be configured to have only a photo-ionizer and a photocathode, without a glow discharge ionizer. An advantage to this configuration is that there is less fragmentation of negative ions created by photo-ionization than ionization by the glow discharge ionizer.

Additionally, negative ionization with the photo-ionizer and photocathode does not require an electric field that can have undesirable effects on the transmission of ions to an analyzer. Yet another advantage is that the PI source can be used for both positive and negative ionization without requiring the glow discharge ionizer, thereby providing a simpler ionization source. Another advantage is that positive and negative ion detection can be rapidly switched by changing voltages on the surrounding electrodes.

The detector may have another embodiment wherein photoemitted electrons are generated using the photo-ionizer, and the electrons are accelerated to sufficiently high energy to achieve positive ionization by the method of electron ionization (EI). One advantage of this method is that it may ionize molecules that are not ionizable by direct photo-ionization. Another advantage of this method is that EI can lead to fragmentation that can assist in identifying unknown molecules or to confirm the identity of a suspected molecule. The extent of fragmentation is also dependent on the electron energy, which is easily varied.

The ionization process may occur at sub-atmospheric pressure (about 1 torr). At sub-atmospheric pressure, the ions are less subject to ion-molecule reactions that can cause the initially formed ions to react to another less identifiable ion than what can occur at atmospheric pressure.

Other configurations of the above embodiments include the use of atmospheric pressure ionization. (API) sources at the sampling side of the above ionization source. These include the use of atmospheric pressure PI (APPI) and atmospheric pressure chemical ionization (APCI), as well as a version of APPI that includes the photocathode surface to generate low energy electrons for negative ionization. The advantage of the use of these API sources in combination with the low-pressure PI/GDI source is increased yield of ions for more sensitive detection and the formation of more characteristic ion masses for specific compounds providing for more definitive molecule identification.

Referring to the drawings more particularly by reference numbers, FIG. 1 shows an embodiment of a detector system 10. The system 10 includes a housing 12 that contains a sample chamber 14, an ionization chamber 16 and a detector chamber 18. The detector chamber 18 may be part of a detector 20 that analyzes an ionized sample. By way of example, the detector may be a mass spectrometer. The various components of the detector 10 may be controlled by a controller 22. The controller 22 may include a processor, memory, power supply, driver circuits, etc. as is known in the art.

The detector system 10 may include a glow discharge ionizer (GDI) 30 and a first photo-ionizer (PI) 32. The GDI 30 may include a first electrode 34 and a second electrode 36 that are coupled to the controller 22. The first electrode 34 may have an inlet 38 that allows a sample to flow from the sample chamber 14 to the ionization chamber 16. The second electrode 36 may have an aperture 40 that allows an ionized sample to enter the detector chamber 18 from the ionization chamber 16. A pump 42 may be coupled to the ionization chamber 16.

In operation, voltages are applied to electrodes 34 and 36 to create a discharge current that causes ionization of the vapor sample. The pressure in the sample chamber 14 may be approximately one atmosphere and the pressure in the ionization chamber 16 may be around one torr. The ions that are formed in chamber 16 are pulled toward the outlet 40 due to the polarity of the voltages applied to electrodes 34 and 36. For negative ion detection the voltage on electrode 36 would be more positive than that on electrode 34. For positive ion detection the voltage on electrode 36 would be less positive than that on electrode 34. Ions that pass through the aperture 40 and into chamber 18 can then be analyzed by the detector 20.

The photo-ionizer 32 may be a lamp that emits a light beam. The vapor molecules that absorb a photon eject an electron to form a positive ion. The detector system 10 can therefore provide both negative ionization by the GDI 30 and positive ionization by the PI source 32. The PI source 32 may contain a lamp electrode 44 that assists in directing ions through the aperture 40 and into the detector.

The detector system 10 may include a photocathode surface 46. When photons of suitable energy impinge on the photocathode 46, electrons may be released in a process called photoemission. These electrons can be used to ionize molecules. If the electrons are of sufficiently low kinetic energy, they can attach to molecules to give negative ions. This is a very useful mode for compounds such as explosives that have high electron affinity. If the electrons have high kinetic energy they can ionize molecules by the known process of electron ionization (EI), which leads to electron ejection from molecules to form positive ions.

The kinetic energy of the photoemitted electrons from the surface is given approximately by $E=h\nu-W-W_{vib}$ where $h\nu$ is the energy of the photon striking the surface, W is the work function or ionization potential of the surface and $W_{vib}$ is vibrational energy acquired by the surface in the process of photoelectron emission. The electron kinetic energy E may be varied by choice of the photon energy $h\nu$ and the type of surface used, which determines the value of W.

By way of example, the photocathode 46 may be metal, such as stainless steel, aluminum, nickel, to name a few common metals, which have work functions in the range of 3–6 eV of energy. The photo-ionizer 32 may then deliver photons of energy of at least 3–6 eV to liberate electrons from the surface.

If the photo-ionizer 32 is used for direct photoionization of molecules it would require energy greater than the ionization potential of the molecules to be analyzed. In U.S. Pat. No. 6,211,516, issued to Syage, which is hereby incorporated by reference, the useful range of photon energies for photoionization of molecules was disclosed to be about 8–12 eV with 10 eV being a useful typical photoionization energy. Because it is desirable to minimize electron energy for electron attachment to form negative ions, it is also disclosed here the use of a lamp of energy less than that needed to photoionize molecules. This has the advantage of generating low energy electrons, such as less than 5 eV. Another advantage is that lower photon energy lamps generally deliver more photons than higher photon energy lamps, which could lead to increased ionization yield.

The detector 10 may have a second photo-ionizer 48. By way of example, the second photo-ionizer 48 may be used for photoionization of molecules to form positive ions, and the first photo-ionizer 32 may be used for photoemission of electrons for electron attachment to form negative ions.

The energy of the photoemitted electron can also be varied by other means besides the photon energy hv and the surface work function W. A voltage may be applied to surface 46, which in conjunction with electrode 44 provides an electric field to accelerate or decelerate the photoemitted electrons. Also the pressure in this region, which is typically at 1 torr, but which may vary from 1 mtorr to 1000 torr, accounts for collisions of the electrons with the surrounding gas that can remove kinetic energy from the electrons. The latter process is useful to minimize electron energy to enhance electron attachment to molecules.

The electric field between electrodes 44 and 46 may be used to accelerate the electrons in order to induce EI of molecules to form positive ions. The greater the electron energy, the more fragmentation that occurs in the ionization of the molecules. The electron energy may therefore be varied to vary the extent of fragmentation, which can help in identifying unknown molecules or confirming the detection of a suspected known molecule.

Figure 2:
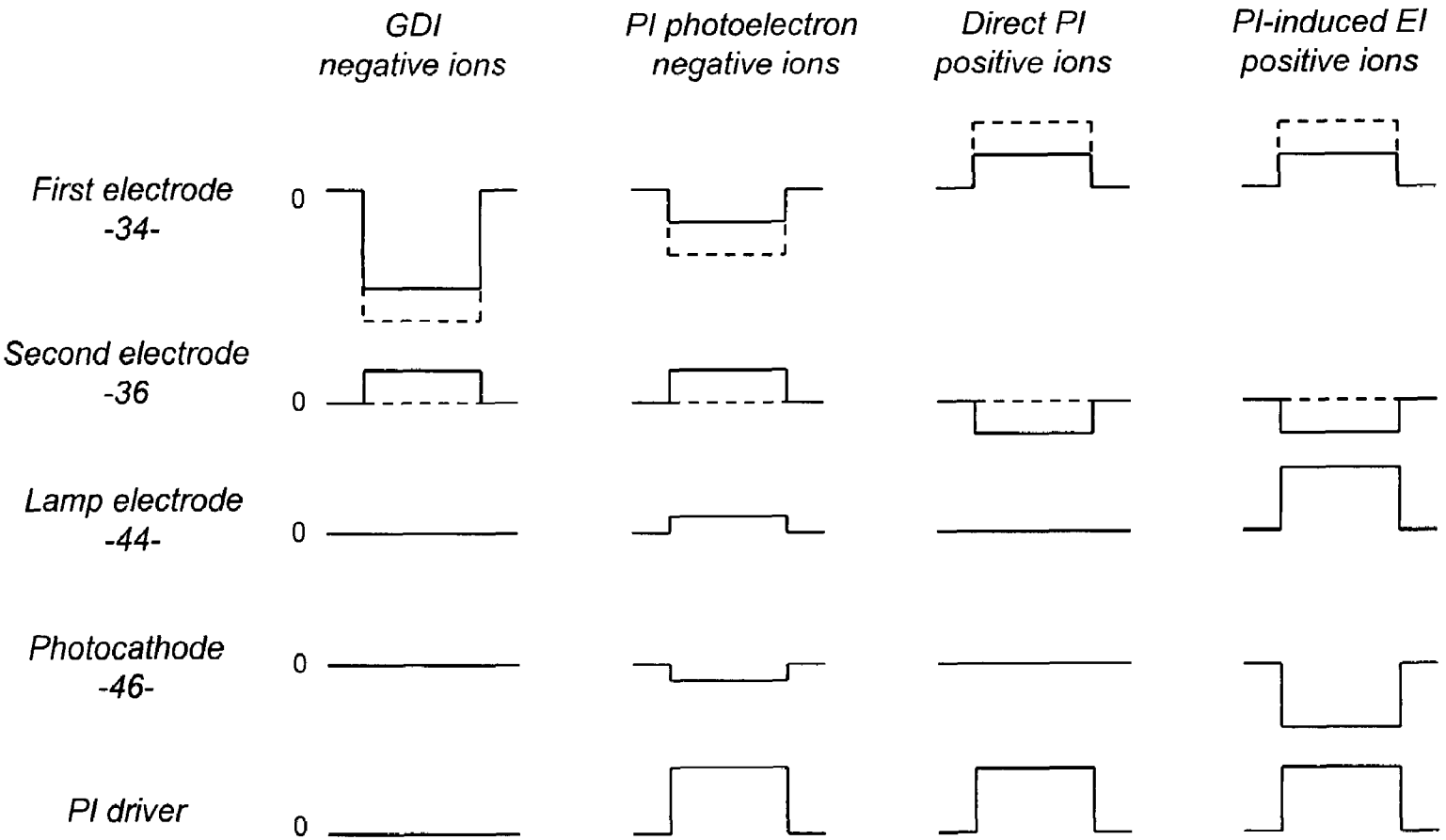
FIG. 2 is a schematic showing the relative voltage levels applied to various components of the detector; and, FIG. 3 is a diagram showing an alternate embodiment of a detector with the photo-ionizer in an ionization chamber having a pressure of approximately one atmosphere.

FIG. 2 shows the relative voltage settings for the electrodes and PI lamp driver shown in FIG. 1 for different ionization modes of operation. The electrodes, 34 and 36, respectively, may be set at a large voltage difference to sustain the glow discharge. By way of example, this voltage difference may be about 400 V/cm for about 0.5 torr of pressure of air. The voltage difference also moves the ions in the desired direction. For negative ion detection, electrode 34 is at negative voltage. Electrode 36 is at a less negative voltage such as ground potential as shown by the dashed line in FIG. 2, or at positive voltage as shown by the solid line in FIG. 2.

The detector has several modes of operation. The means of generating negative ions using the PI source 32 is represented in FIG. 2 by the voltages represented under PI photoelectron negative ions. Similar to the GDI source for negative ion detection, the electrodes 44 and 46 are set to move negative ions in the direction of the outlet 40. The photons strike the photocathode surface 46 and the photoemitted electrons are made to traverse the ionization region between electrodes 44 and 46 by applying a low positive voltage (about 0 to 20 V) to electrode 44 and a low negative voltage (about 0 to −20 V) to electrode 46. Other voltages may be applied to achieve a similar effect. Because of the interaction of the voltages on electrodes 34, 36, 44, and 46, and the effects of collisions with the background gas, the optimum voltages may differ from the suggested voltages in a manner that would be evident to a practitioner skilled in the art.

The PI source may also be used for direct photoionization of molecules to form positive ions. The advantage of this mode is that it generates ions with minimal fragmentation because the photon energy hv is typically at a value only slightly above the ionization potential of the molecule. In this mode the electrodes 34 and 36 have applied voltages that move positive ions in the direction of the exit aperture 40 in a manner opposite to that described above for analyzing negative ions. It is often convenient to set electrode 36 at ground potential as shown by the dotted lines in FIG. 2. For direct photoionization to form positive ions, the electrode 44 and photocathode 46 are not needed. However, it may be advantageous to apply voltages to these electrodes to optimize the yield of ions that pass through the aperture 40 to an ion analyzer in chamber 18.

Another mode of ionization that uses the PI source is represented by the voltages shown under PI-induced EI positive ions in FIG. 2. This mode is based on the impingement of photons from photo-ionizer 32 onto the photocathode surface 46 in a manner similar to that used to generate low energy photoelectrons for negative ionization. In the present case, the electrons are accelerated to sufficiently high energy (greater than 10 eV) to achieve EI of the sample vapor molecules leading to positive ions. EI can lead to fragmentation of the ions. The extent of fragmentation is dependent on the electron energy, which can be easily varied by adjusting the voltages on the photo-ionizer and electrodes 44 and 46. A typical range of voltages that would give a useful range of fragmentation would be about 5 to 200 V and −5 to −200 V, respectively.

The above disclosures describe the operation of each mode individually. It is also possible to operate some of these modes simultaneously, such as the two modes of negative ionization at the same time or the two modes of positive ionization at the same time. It is also useful to switch between modes of operation. This switching can be performed very quickly by rapidly controlling the voltages that are represented in FIG. 2. For example it would be possible to perform each mode of operation in FIG. 2 in sequence or in some combinations in about one second. The switching of the voltages can be done routinely by the controller 22 shown in FIG. 1.

Figure 3:
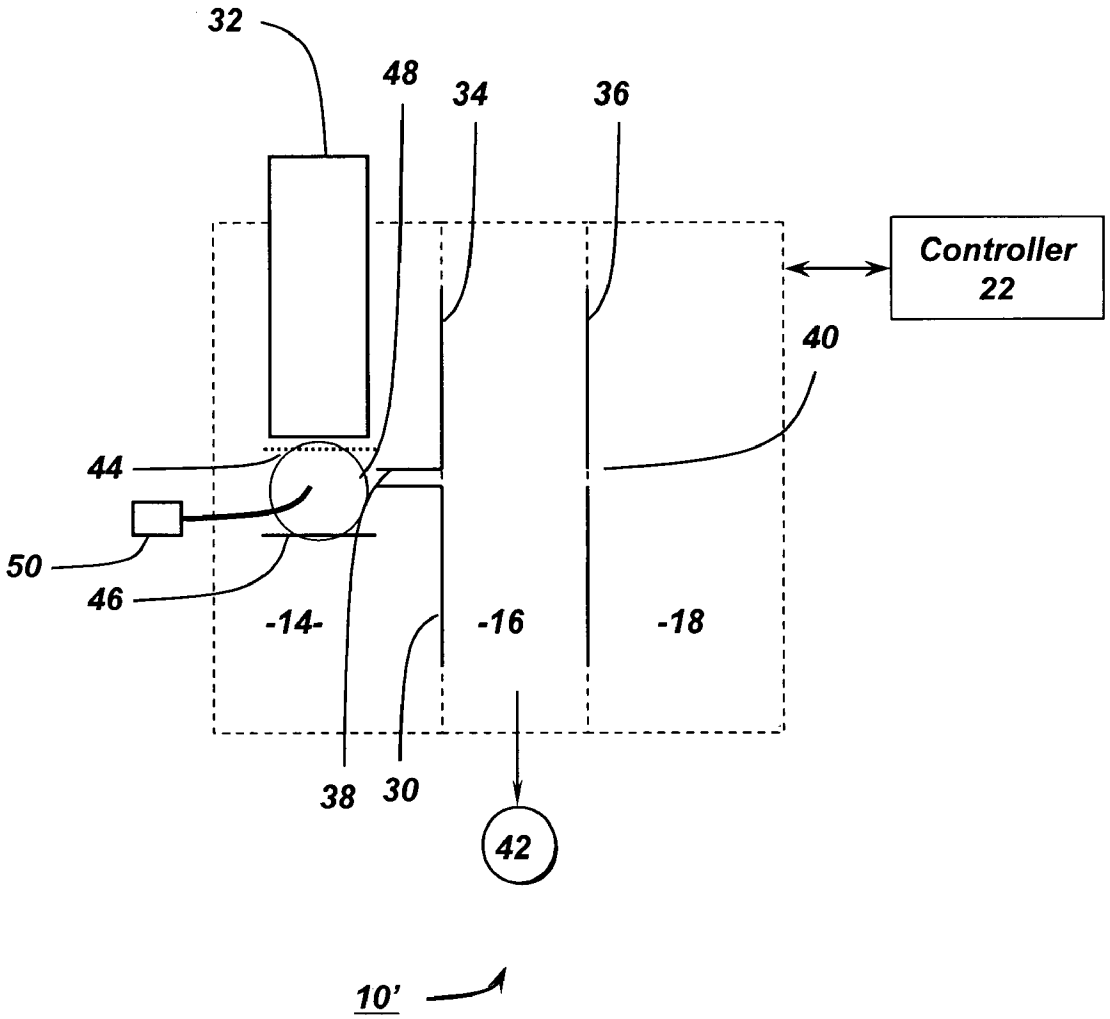

FIG. 3 shows an alternate embodiment of a detector system 10' with a PI source 32 in the sample chamber 14 to create a second ionization chamber. The photo-ionizer 32, electrode 44 and photocathode 46 have similar functions to those represented in the low pressure region 12 in FIG. 1. The detector system 10 may also have a discharge needle 50 for generating a discharge current that can lead to ionization of molecules to form both positive and negative ions. The ions are then directed toward inlet 38 using electric fields set up by electrodes 34, 44, and 46 as well as other electrodes that the practitioner may choose to use to optimize the transmission efficiency of ions through inlet 38. The photo-ionization source consisting of components 32, 44, and 46 can be used for direct PI to form positive ions and by photoemission of electrons from surface 48 to form low energy electron attachment to form negative ions. The means to achieve these modes are similar to that described above for the detector shown in FIG. 1 and represented in FIG. 2.

The photoemitted electrons may not be accelerated to sufficient energy to achieve EI in the one atmosphere region 14 due to the high frequency of collisions of the electron with the surrounding gas. The discharge needle 50 is a useful complement to the GDI source 10 in region 12. Whereas the GDI source is less susceptible to undesirable ion-molecule collisions that can deplete the desired ion signal, it is also the case that ion fragmentation occurs often. Conversely, the operation of a discharge needle 50 in the one atmosphere region 14 is more susceptible to the undesirable ion-molecule reactions, however, the ions that are formed undergo less fragmentation than the GDI source. It is therefore very useful to operate both modes of discharge ionization to improve the detection accuracy of a molecule.

It is also an advantage of operating ionizers in both regions 14 and 16 in order to increase the total yield of ions that are formed, thereby potentially increasing the sensitivity to detection of trace molecules. Although not shown in FIG. 3, the detector system 10' may have one or more photo-ionizers in chamber 16. The use of all, or combinations of these sources and various methods of switching the sources should be evident to the practitioner skilled in the art based on the technical description presented above.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A detector system that detects a trace molecule from a sample, comprising:

a glow discharge ionizer that includes a first electrode, and a second electrode separated by a first ionization chamber, said glow discharge ionizer ionizes the sample;

a first photo-ionizer that ionizes the sample in said first ionization chamber; and, a detector coupled to said first ionization chamber.

2. The system of claim 1, further comprising a photocathode coupled to said first photo-ionizer.

3. The system of claim 2, further comprising a lamp electrode coupled to said first photo-ionizer.

4. The system of claim 1, further comprising a second photo-ionizer that ionizes the sample.

5. The system of claim 1, wherein said first electrode has an inlet, and said second electrode has an aperture that provides communication between said first ionization chamber and said detector.

6. The system of claim 1, wherein said first electrode has a higher voltage potential than said second electrode.

7. The system of claim 1, wherein said first electrode has a lower voltage potential than said second electrode.

8. The system of claim 1, wherein said first photo-ionizer is located in a second ionization chamber.

9. The system of claim 1, further comprising a pump coupled to said first ionization chamber to create a vacuum in said first ionization chamber.

10. The system of claim 8, wherein said second ionization chamber has a pressure of approximately one atmosphere.

11. The system of claim 1, wherein said detector includes a mass spectrometer.

12. A method for detecting a trace molecule from a sample, comprising:

ionizing a sample with a glow discharge ionizer that has a first electrode, and a second electrode separated by a first ionization chamber;

ionizing the sample with a first photo-ionizer in the first ionization chamber; and, detecting a trace molecule from the ionized sample.

13. The method of claim 12, wherein the first photo-ionizer emits a beam of light that impinges on a photocathode to create electrons.

14. The method of claim 13, further comprising accelerating the electrons toward a lamp electrode.

15. The method of claim 12, ionizing the sample with a second photo-ionizer.

16. The method of claim 12, wherein the sample is simultaneously ionized by the glow discharge ionizer and the first photo-ionizer.

17. The method of claim 12, wherein the glow discharge ionizer creates negative ions and the first photo-ionizer creates positive ions.

18. A detector system that detects a trace molecule from a sample, comprising:

a glow discharge ionizer that includes a first electrode, and a second electrode separated by a first ionization chamber, said glow discharge ionizer ionizes the sample ionization chamber;

a first photo-ionizer that ionizes the sample;

a photocathode coupled to said first photo-ionizer; and, a detector coupled to said ionization chamber.

19. The system of claim 18, further comprising a lamp electrode coupled to said photocathode.

20. The system of claim 18, further comprising a second photo-ionizer located within said ionization chamber.

21. The system of claim 18, wherein said detector includes a mass spectrometer.

22. A method for detecting a trace molecule from a sample, comprising:

ionizing a sample by directing a light beam from a first photo-ionizer onto a photocathode to release an electron;

ionizing the sample with a second photo-ionizer; and, detecting a trace molecule from the ionized sample.

23. The method of claim 22, further comprising accelerating the electrons toward a lamp electrode.

24. The method of claim 23, wherein the first photo-ionizer and the photocathode create negative ions, and the second photo-ionizer creates positive ions.

* * * * *